US005368659A

United States Patent [19]

Peker et al.

[11] Patent Number: 5,368,659

[45] Date of Patent: Nov. 29, 1994

[54] METHOD OF FORMING BERRYLLIUM BEARING METALLIC GLASS

[75] Inventors: Atakan Peker; William L. Johnson, both of Pasadena, Calif.

[73] Assignee: California Institute of Technology, Pasadena, Calif.

[21] Appl. No.: 198,873

[22] Filed: Feb. 18, 1994

Related U.S. Application Data

[62] Division of Ser. No. 44,814, Apr. 7, 1993, Pat. No. 5,288,344.

[51] Int. Cl.[5] ..... C22C 9/00; C22C 14/00

[52] U.S. Cl. ..... 148/403; 148/672; 420/417; 420/421; 420/422

[58] Field of Search ..... 148/403, 672; 420/417, 420/422, 421

[56] References Cited

U.S. PATENT DOCUMENTS

| | | | |
|---|---|---|---|
| 3,989,517 | 11/1976 | Tanner et al. | 75/175.5 |
| 4,050,931 | 9/1977 | Tanner et al. | 75/175.5 |
| 4,064,757 | 12/1977 | Hasegawa | 148/403 |
| 4,113,478 | 9/1978 | Tanner et al. | 75/177 |
| 4,116,687 | 9/1978 | Hasegawa | 420/422 |
| 4,126,449 | 11/1978 | Tanner et al. | 75/164 |
| 4,135,924 | 1/1979 | Tanner et al. | 75/159 |
| 4,721,154 | 1/1988 | Christ et al. | 164/452 |
| 4,990,198 | 2/1991 | Masumoto et al. | 148/403 |
| 5,032,196 | 7/1991 | Masumoto et al. | 148/403 |
| 5,043,023 | 8/1991 | Gerling et al. | 148/403 |
| 5,053,084 | 10/1991 | Masumoto et al. | 148/11.5 |
| 5,053,085 | 10/1991 | Masumoto et al. | 148/11.5 |
| 5,250,124 | 10/1993 | Yamaguchi et al. | 148/403 |
| 5,312,495 | 5/1994 | Masumoto et al. | 148/550 |

OTHER PUBLICATIONS

Zhang, et al., Amorphous Zr-Al-TM(Tm=Co,Ni,Cu) Alloys with Significant Supercooled Liquid Region of Over 100 K, *Materials Transactions,* 1991, pp. 1005 thru 1010.

Inoue, et al., Zr-Al-Ni Amorphous Alloys with High Glass Transition Temperature and Significant Supercooled Liquid Region, *Materials Transactions,* 1990, pp. 179 thru 183.

Tanner, et al., P Physical Properties of $Ti_{50}Be_{40}Zr_{10}$ Glass, *Scripta Metallurgica,* vol. 11, pp. 783-789, 1977.

Tanner, Physical Properties of Ti-Be-Si Glass Ribbons, *Scripta Metallurgica* vol. 12, pp. 703-708, 1978.

Hasegawa, et al., Superconducting Properties of Be-Zr Glassy Alloys Obtained By Liquid Quenching, Physical Review B, vol. 16, No. 9, Nov. 1977, pp. 3925-3928.

Tanner, The Stable and Metastable Phase Relations in the Hf-Be Alloy System, Metallurgica, vol. 28. pp. 1805-1816.

Maret, et al., Structural Study of $Be_{43}Hf_xZr_{57-x}$ Metallic Glasses by X-Ray and Neutron Diffraction, *J. Physique 47,* 1986, pp. 863-871.

Jost, et al., The Structure of Amorphous Be-Ti-Zr Alloys, *Zeitschrift Fur Physikalische Chemie Neue Folge,* Bd.157, S.11-15, 1988.

Tanner, et al., Metallic Glass Formation and Properties in Zr and Ti Alloyed with Be-I The Binary Zr-Be and Ti-Be Systems, ACTA Metallurgica, vol. 27, pp. 1727 to 1747, 1979.

*Primary Examiner*—Upendra Roy

*Attorney, Agent, or Firm*—Christie, Parker & Hale

[57] ABSTRACT

Alloys which form metallic glass upon cooling below the glass transition temperature at a rate appreciably less than $10^6$ K/s comprise beryllium in the range of from 2 to 47 atomic percent and at least one early transition metal in the range of from 30 to 75% and at least one late transition metal in the range of from 5 to 62%. A preferred group of metallic glass alloys has the formula $(Zr_{1-x}Ti_x)_a(Cu_{1-y}Ni_y)_bBe_c$. Generally, a is in the range from 30 to 75% and the lower limit increases with increasing x. When x is in the range of from 0 to 0.15, b is in the range of from 5 to 62%, and c is in the range of from 6 to 47%. When x is in the range of from 0.15 to 0.4, b is in the range of from 5 to 62%, and c is in the range of from 2 to 47%. When x is in the range of from 0.4 to 0.6, b is in the range of from 5 to 62%, and c is in the range of from 2 to 47%. When x is in the range of from 0.6 to 0.8, b is in the range of from 5 to 62%, and c is in the range of from 2 to 42%. When x is in the range of from 0.8 to 1, b is in the range of from 5 to 62%, and c is in the range of from 2 to 30%. Other elements may also be present in the alloys in varying proportions.

53 Claims, 4 Drawing Sheets

METHOD OF FORMING BERRYLLIUM BEARING METALLIC GLASS

BACKGROUND

This application is a division of U.S. patent application Ser. No. 08/044,814, filed Apr. 7, 1993 now U.S. Pat. No. 5,288,344. This application also contains variations in the composition of glass forming alloys as compared with the parent application. The new boundaries of the glass forming regions are based on additional experimental data.

This invention relates to amorphous metallic alloys, commonly referred to metallic glasses, which are formed by solidification of alloy melts by cooling the alloy to a temperature below its glass transition temperature before appreciable homogeneous nucleation and crystallization has occurred.

There has been appreciable interest in recent years in the formation of metallic alloys that are amorphous or glassy at low temperatures. Ordinary metals and alloys crystallize when cooled from the liquid phase. It has been found, however, that some metals and alloys can be undercooled and remain as an extremely viscous liquid phase or glass at ambient temperatures when cooled sufficiently rapidly. Cooling rates in the order of $10^4$ to $10^6$ K/sec are typically required.

To achieve such rapid cooling rates, a very thin layer (e.g., less than 100 micrometers) or small droplets of molten metal are brought into contact with a conductive substrate maintained at near ambient temperature. The small dimension of the amorphous material is a consequence of the need to extract heat at a sufficient rate to suppress crystallization. Thus, previously developed amorphous alloys have only been available as thin ribbons or sheets or as powders. Such ribbons, sheets or powders may be made by melt-spinning onto a cooled substrate, thin layer casting on a cooled substrate moving past a narrow nozzle, or as "splat quenching" of droplets between cooled substrates.

Appreciable efforts have been directed to finding amorphous alloys with greater resistance to crystallization so that less restrictive cooling rates can be utilized. If crystallization can be suppressed at lower cooling rates, thicker bodies of amorphous alloys can be produced.

The formation of amorphous metallic alloys always faces the difficult tendency of the undercooled alloy melt to crystallize. Crystallization occurs by a process of nucleation and growth of crystals. Generally speaking, an undercooled liquid crystallizes rapidly. To form an amorphous solid alloy, one must melt the parent material and cool the liquid from the melting temperature $T_m$ to below the glass transition temperature $T_g$ without the occurrence of crystallization.

FIG. 1 illustrates schematically a diagram of temperature plotted against time on a logarithmic scale. A melting temperature $T_m$ and a glass transition temperature $T_g$ are indicated. An exemplary curve a indicates the onset of crystallization as a function of time and temperature. In order to create an amorphous solid material, the alloy must be cooled from above the melting temperature through the glass transition temperature without intersecting the nose of the crystallization curve. This crystallization curve a represents schematically the onset of crystallization on some of the earliest alloys from which metallic glasses were formed. Cooling rates in excess of $10^5$ and usually in the order of $10^6$ have typically been required.

A second curve b in FIG. 1 indicates a crystallization curve for subsequently developed metallic glasses. The required cooling rates for forming amorphous alloys have been decreased one or two, or even three, orders of magnitude, a rather significant decrease. A third crystallization curve c indicates schematically the order of magnitude of the additional improvements made in practice of this invention. The nose of the crystallization curve has been shifted two or more orders of magnitude toward longer times. Cooling rates of less than $10^3$ K/s and preferably less than $10^2$ K/s are achieved. Amorphous alloys have been obtained with cooling rates as low as two or three K/s.

The formation of an amorphous alloy is only part of the problem. It is desirable to form net shape components and three dimensional objects of appreciable dimensions from the amorphous materials. To process and form an amorphous alloy or to consolidate amorphous powder to a three dimensional object with good mechanical integrity requires that the alloy be deformable. Amorphous alloys undergo substantial homogeneous deformation under applied stress only when heated near or above the glass transition temperature. Again, crystallization is generally observed to occur rapidly in this temperature range.

Thus, referring again to FIG. 1, if an alloy once formed as an amorphous solid is reheated above the glass transition temperature, a very short interval may exist before the alloy encounters the crystallization curve. With the first amorphous alloys produced, the crystallization curve a would be encountered in milliseconds and mechanical forming above the glass transition temperature is essentially infeasible. Even with improved alloys, the time available for processing is still in the order of fractions of seconds or a few seconds.

FIG. 2 is a schematic diagram of temperature and viscosity on a logarithmic scale for amorphous alloys as undercooled liquids between the melting temperature and glass transition temperature. The glass transition temperature is typically considered to be a temperature where the viscosity of the alloy is in the order of $10^{12}$ poise. A liquid alloy, on the other hand, may have a viscosity of less than one poise (ambient temperature water has a viscosity of about one centipoise).

As can be seen from the schematic illustration of FIG. 2, the viscosity of the amorphous alloy decreases gradually at low temperatures, then changes rapidly above the glass transition temperature. An increase of temperature as little as 5° C. can reduce viscosity an order of magnitude. It is desirable to reduce the viscosity of an amorphous alloy as low as $10^5$ poise to make deformation feasible at low applied forces. This means appreciable heating above the glass transition temperature. The processing time for an amorphous alloy (i.e., the elapsed time from heating above the glass transition temperature to intersection with the crystallization curve of FIG. 1) is preferably in the order of several seconds or more, so that there is ample time to heat, manipulate, process and cool the alloy before appreciable crystallization occurs. Thus, for good formability, it is desirable that the crystallization curve be shifted to the right, i.e., toward longer times.

The resistance of a metallic glass to crystallization can be related to the cooling rate required to form the glass upon cooling from the melt. This is an indication of the stability of the amorphous phase upon heating above the glass transition temperature during processing. It is desirable that the cooling rate required to suppress crystallization be in the order of from 1 K/s to $10^3$ K/s or even less. As the critical cooling rate decreases, greater times are available for processing and larger cross sections of parts can be fabricated. Further, such alloys can be heated substantially above the glass transition temperature without crystallizing during time scales suitable for industrial processing.

BRIEF SUMMARY OF THE INVENTION

Thus, there is provided in practice of this invention according to a presently preferred embodiment a class of alloys which form metallic glass upon cooling below the glass transition temperature at a rate less than $10^3$ K/s. Such alloys comprise beryllium in the range of from 2 to 47 atomic percent, or a narrower range depending on other alloying elements and the critical cooling rate desired, and at least two transition metals. The transition metals comprise at least one early transition metal in the range of from 30 to 75 atomic percent, and at least one late transition metal in the range of from 5 to 62 atomic percent, depending on what alloying elements are present in the alloy. The early transition metals include Groups 3, 4, 5 and 6 of the periodic table, including lanthanides and actinides. The late transition metals include Groups 7, 8, 9, 10 and 11 of the periodic table.

A preferred group of metallic glass alloys has the formula $(Zr_{1-x}Ti_x)_a(Cu_{1-y}Ni_y)_bBe_c$, where x and y are atomic fractions, and a, b and c are atomic percentages. In this formula, the values of a, b and c partly depend on the proportions of zirconium and titanium. Thus, when x is in the range of from 0 to 0.15, a is in the range of from 30 to 75%, b is in the range of from 5 to 62%, and c is in the range of from 6 to 47%. When x is in the range of from 0.15 to 0.4, a is in the range of from 30 to 75%, b is in the range of from 5 to 62%, and c is in the range of from 2 to 47%. When x is in the range of from 0.4 to 0.6, a is in the range of from 35 to 75%, b is in the range of from 5 to 62%, and c is in the range of from 2 to 47%. When x is in the range of from 0.6 to 0.8, a is in the range of from 35 to 75%, b is in the range of from 5 to 62%, and c is in the range of from 2 to 42%. When x is in the range of from 0.8 to 1, a is in the range of from 35 to 75%, b is in the range of from 5 to 62%, and c is in the range of from 2 to 30%, under the constraint that 3c is up to (100−b) when b is in the range of from 10 to 49%.

Furthermore, the $(Zr_{1-x}Ti_x)$ moiety may also comprise additional metal selected from the group consisting of from 0 to 25% hafnium, from 0 to 20% niobium, from 0 to 15% yttrium, from 0 to 10% chromium, from 0 to 20% vanadium, from 0 to 5% molybdenum, from 0 to 5% tantalum, from 0 to 5% tungsten, and from 0 to 5% lanthanum, lanthanides, actinium and actinides. The $(Cu_{1-y}Ni_y)$ moiety may also comprise additional metal selected from the group consisting of from 0 to 25% iron, from 0 to 25% cobalt, from 0 to 15% manganese and from 0 to 5% of other Group 7 to 11 metals. The beryllium moiety may also comprise additional metal selected from the group consisting of up to 15% aluminum with the beryllium content being at least 6%, up to 5% silicon and up to 5% boron. Other elements in the composition should be less than two atomic percent.

BRIEF DESCRIPTION OF THE DRAWINGS

These and other features and advantages of the present invention will be appreciated as the same becomes better understood by reference to the following detailed description when considered in connection with the accompanying drawings wherein.

DETAILED DESCRIPTION

Figure 1:
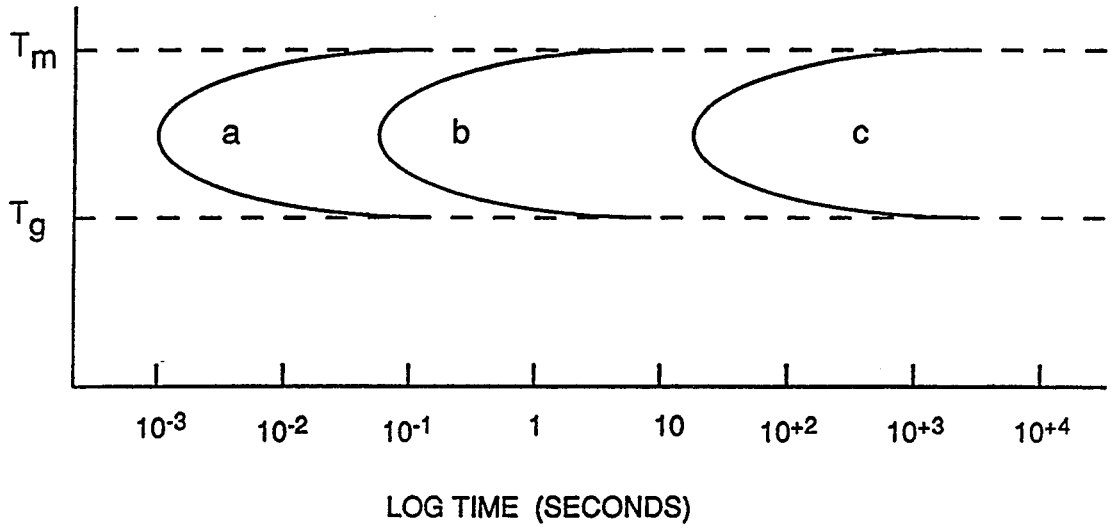
FIG. 1 illustrates schematic crystallization curves for amorphous or metallic glass alloys.
Figure 2:
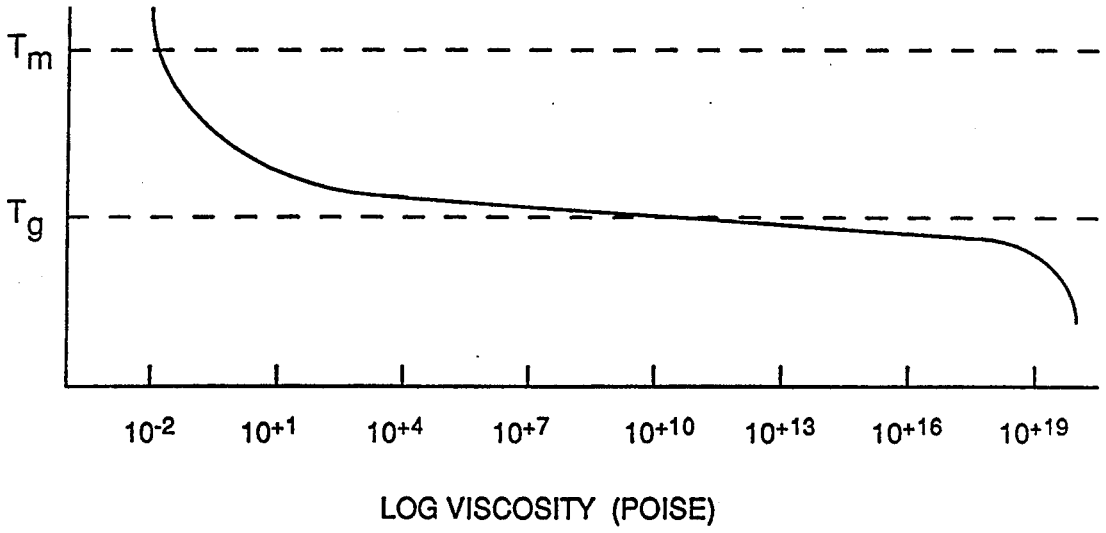
FIG. 2 illustrates schematically viscosity of an amorphous glass alloy.

For purposes of this invention, a metallic glass product is defined as a material which contains at least 50% by volume of the glassy or amorphous phase. Glass forming ability can be verified by splat quenching where cooling rates are in the order of $10^6$ K/s. More frequently, materials provided in practice of this invention comprise substantially 100% amorphous phase. For alloys usable for making parts with dimensions larger than micrometers, cooling rates of less than $10^3$ K/s are desirable. Preferably, cooling rates to avoid crystallization are in the range of from 1 to 100 K/sec or lower. For identifying acceptable glass forming alloys, the ability to cast layers at least 1 millimeter thick has been selected.

Such cooling rates may be achieved by a broad variety of techniques, such as casting the alloys into cooled copper molds to produce plates, rods, strips or net shape parts of amorphous materials with dimensions ranging from 1 to 10 mm or more, or casting in silica or other glass containers to produce rods with exemplary diameters of 15 mm or more.

Conventional methods currently in use for casting glass alloys, such as splat quenching for thin foils, single or twin roller melt-spinning, water melt-spinning, or planar flow casting of sheets may also be used. Because of the slower cooling rates feasible, and the stability of the amorphous phase after cooling, other more economical techniques may be used for making net shape parts or large bodies that can be deformed to make net shape parts, such as bar or ingot casting, injection molding, powder metal compaction and the like.

A rapidly solidified powder form of amorphous alloy may be obtained by any atomization process which divides the liquid into droplets. Spray atomization and gas atomization are exemplary. Granular materials with a particle size of up to 1 mm containing at least 50% amorphous phase can be produced by bringing liquid drops into contact with a cold conductive substrate with high thermal conductivity, or introduction into an inert liquid. Fabrication of these materials is preferably done in inert atmosphere or vacuum due to high chemical reactivity of many of the materials.

A variety of new glass forming alloys have been identified in practice of this invention. The ranges of alloys suitable for forming glassy or amorphous material can be defined in various ways. Some of the composition ranges are formed into metallic glasses with relatively higher cooling rates, whereas preferred compositions form metallic glasses with appreciably lower cooling rates. Although the alloy composition ranges are defined by reference to a ternary or quasi-ternary composition diagram such as illustrated in FIGS. 3 to 6, the boundaries of the alloy ranges may vary somewhat as different materials are introduced. The boundaries encompass alloys which form a metallic glass when cooled from the melting temperature to a temperature below the glass transition temperature at a rate less than about $10^6$ K/s, preferably less than $10^3$ K/s and often at much lower rates, most preferably less than 100 K/s.

Generally speaking, reasonable glass forming alloys have at least one early transition metal, at least one late transition metal and beryllium. Good glass forming can be found in some ternary beryllium alloys. However, even better glass forming, i.e., lower critical cooling rates to avoid crystallization are found with quaternary alloys with at least three transition metals. Still lower critical cooling rates are found with quintenary alloys, particularly with at least two early transition metals and at least two late transition metals.

It is a common feature of the broadest range of metallic glasses that the alloy contains from 2 to 47 atomic percent beryllium. (Unless indicated otherwise, composition percentages stated herein are atomic percentages.) Preferably, the beryllium content is from about 10 to 35%, depending on the other metals present in the alloy. A broad range of beryllium contents (6 to 47%) is illustrated in the ternary or quasi-ternary composition diagram of FIG. 3 for a class of compositions where the early transition metal comprises zirconium and/or zirconium with a relatively small amount of titanium, e.g. 5%.

Figure 3:
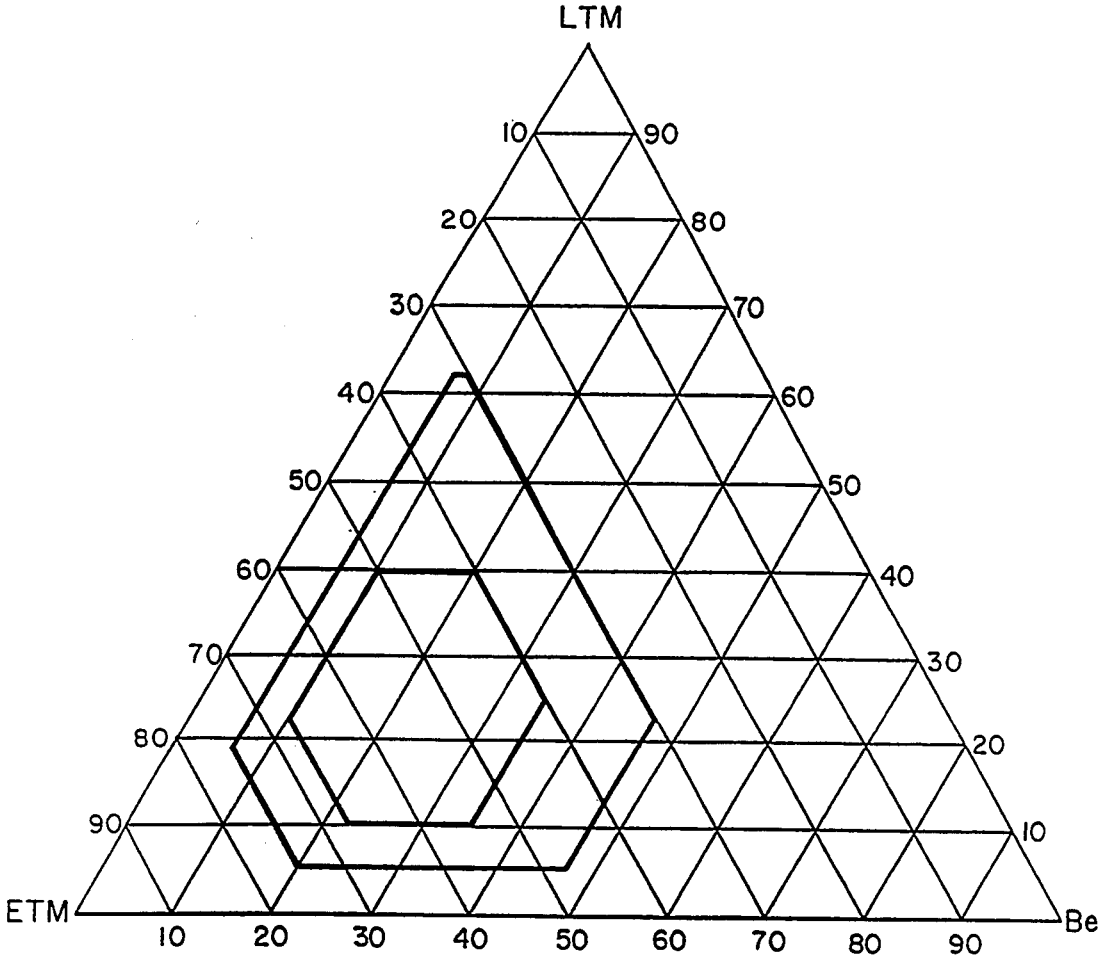
FIG. 3 is a quasi-ternary composition diagram indicating a glass forming region of alloys provided in practice of this invention.

A second apex of a ternary composition diagram, such as illustrated in FIG. 3, is an early transition metal (ETM) or mixture of early transition metals. For purposes of this invention, an early transition metal includes Groups 3, 4, 5, and 6 of the periodic table, including the lanthanide and actinide series. The previous IUPAC notation for these groups was IIIA, IVA, VA and VIA. The early transition metal is present in the range of from 30 to 75 atomic percent. Preferably, the early transition metal content is in the range of from 40 to 67%.

The third apex of the ternary composition diagram represents a late transition metal (LTM) or mixture of late transition metals. For purposes of this invention, late transition metals include Groups 7, 8, 9, 10 and 11 of the periodic table. The previous IUPAC notation was VIIA, VIIIA and IB. Glassy alloys are prepared with late transition metal in quaternary or more complex alloys in the range of from 5 to 62 atomic percent. Preferably, the late transition metal content is in the range of from 10 to 48%.

Many ternary alloy compositions with at least one early transition metal and at least one late transition metal where beryllium is present in the range of from 2 to 47 atomic percent form good glasses when cooled at reasonable cooling rates. The early transition metal content is in the range of from 30 to 75% and the late transition metal content is in the range of from 5 to 62%.

FIG. 3 illustrates a smaller hexagonal figure on the ternary composition diagram representing the boundaries of preferred alloy compositions which have a critical cooling rate for glass formation less than about $10^3$ K/s, and many of which have critical cooling rates lower than 100 K/s. In this composition diagram, ETM refers to early transition metals as defined herein, and LTM refers to late transition metals. The diagram could be considered quasiternary since many of the glass forming compositions comprise at least three transition metals and may be quintenary or more complex compositions.

A larger hexagonal area illustrated in FIG. 3 represents a glass forming region of alloys having somewhat higher critical cooling rates. These areas are bounded by the composition ranges for alloys having a formula $$(Zr_{1-x}Ti_x)_{a1}ETM_{a2}(Cu_{1-y}Ni_y)_{b1}LTM_{b2}Be_c$$

In this formula x and y are atomic fractions, and a1, a2, b1, b2, and c are atomic percentages. ETM is at least one additional early transition metal. LTM is at least one additional late transition metal. In this example, the amount of other ETM is in the range of from 0 to 0.4 times the total content of zirconium and titanium and x is in the range of from 0 to 0.15. The total early transition metal, including the zirconium and/or titanium, is in the range of from 30 to 75 atomic percent. The total late transition metal, including the copper and nickel, is in the range of from 5 to 62%. The amount of beryllium is in the range of from 6 to 47%.

Within the smaller hexagonal area defined in FIG. 3 there are alloys having low critical cooling rates. Such alloys have at least one early transition metal, at least one late transition metal and from 10 to 35% beryllium. The total ETM content is in the range of from 40 to 67% and the total LTM content is in the range of from 10 to 48%.

When the alloy composition comprises copper and nickel as the only late transition metals, a limited range of nickel contents is preferred. Thus, when b2 is 0 (i.e. when no other LTM is present) and some early transition metal in addition to zirconium and/or titanium is present, it is preferred that y (the nickel content) be in the range of from 0.35 to 0.65. In other words, it is preferred that the proportions of nickel and copper be about equal. This is desirable since other early transition metals are not readily soluble in copper and additional nickel aids in the solubility of materials such as vanadium, niobium, etc.

Preferably, when the content of other ETM is low or zirconium and titanium are the only early transition metals, the nickel content is from about to 5 to 15% of the composition. This can be stated with reference to the stoichiometric type formula as having by in the range of from 5 to 15.

Previous investigations have been of binary and ternary alloys which form metallic glass at very high cooling rates. It has been discovered that quaternary, quintenary or more complex alloys with at least three transition metals and beryllium form metallic glasses with much lower critical cooling rates than previously thought possible.

It is also found that with adequate beryllium contents ternary alloys with at least one early transition metal and at least one late transition metal form metallic glasses with lower critical cooling rates than previous alloys.

In addition to the transition metals outlined above, the metallic glass alloy may include up to 20 atomic percent aluminum with a beryllium content remaining above six percent, up to two atomic percent silicon, and up to five atomic percent boron, and for some alloys, up to five atomic percent of other elements such as Bi, Mg, Ge, P, C, O, etc. Preferably the proportion of other elements in the glass forming alloy is less than 2%. Preferred proportions of other elements include from 0 to 15% Al, from 0 to 2% B and from 0 to 2% Si.

Preferably, the beryllium content of the aforementioned metallic glasses is at least 10 percent to provide low critical cooling rates and relatively long processing times.

The early transition metals are selected from the group consisting of zirconium, hafnium, titanium, vanadium, niobium, chromium, yttrium, neodymium, gadolinium and other rare earth elements, molybdenum, tantalum, and tungsten in descending order of preference. The late transition metals are selected from the group consisting of nickel, copper, iron, cobalt, manganese, ruthenium, silver and palladium in descending order of preference.

A particularly preferred group consists of zirconium, hafnium, titanium, niobium, and chromium (up to 20% of the total content of zirconium and titanium) as early transition metals and nickel, copper, iron, cobalt and manganese as late transition metals. The lowest critical cooling rates are found with alloys containing early transition metals selected from the group consisting of zirconium, hafnium and titanium and late transition metals selected from the group consisting of nickel, copper, iron and cobalt.

A preferred group of metallic glass alloys has the formula $(Zr_{1-x}Ti_x)_a(Cu_{1-y}Ni_y)_bBe_c$, where x and y are atomic fractions, and a, b and c are atomic percentages. In this composition, x is in the range of from 0 to 1, and y is in the range of from 0 to 1. The values of a, b and c depend to some extent on the magnitude of x. When x is in the range of from 0 to 0.15, a is in the range of from 30 to 75%, b is in the range of from 5 to 62%, and c is in the range of from 6 to 47%. When x is in the range of from 0.15 to 0.4, a is in the range of from 30 to 75%, b is in the range of from 5 to 62%, and c is in the range of from 2 to 47%. When x is in the range of from 0.4 to 0.6, a is in the range of from 35 to 75%, b is in the range of from 5 to 62%, and c is in the range of from 2 to 47%. When x is in the range of from 0.6 to 0.8, a is in the range of from 35 to 75%, b is in the range of from 5 to 62%, and c is in the range of from 2 to 42%. When x is in the range of from 0.8 to 1, a is in the range of from 35 to 75%, b is in the range of from 5 to 62%, and c is in the range of from 2 to 30%, under the constraint that c is up to (100−b) when b is in the range of from 10 to 49%.

Figure 4:
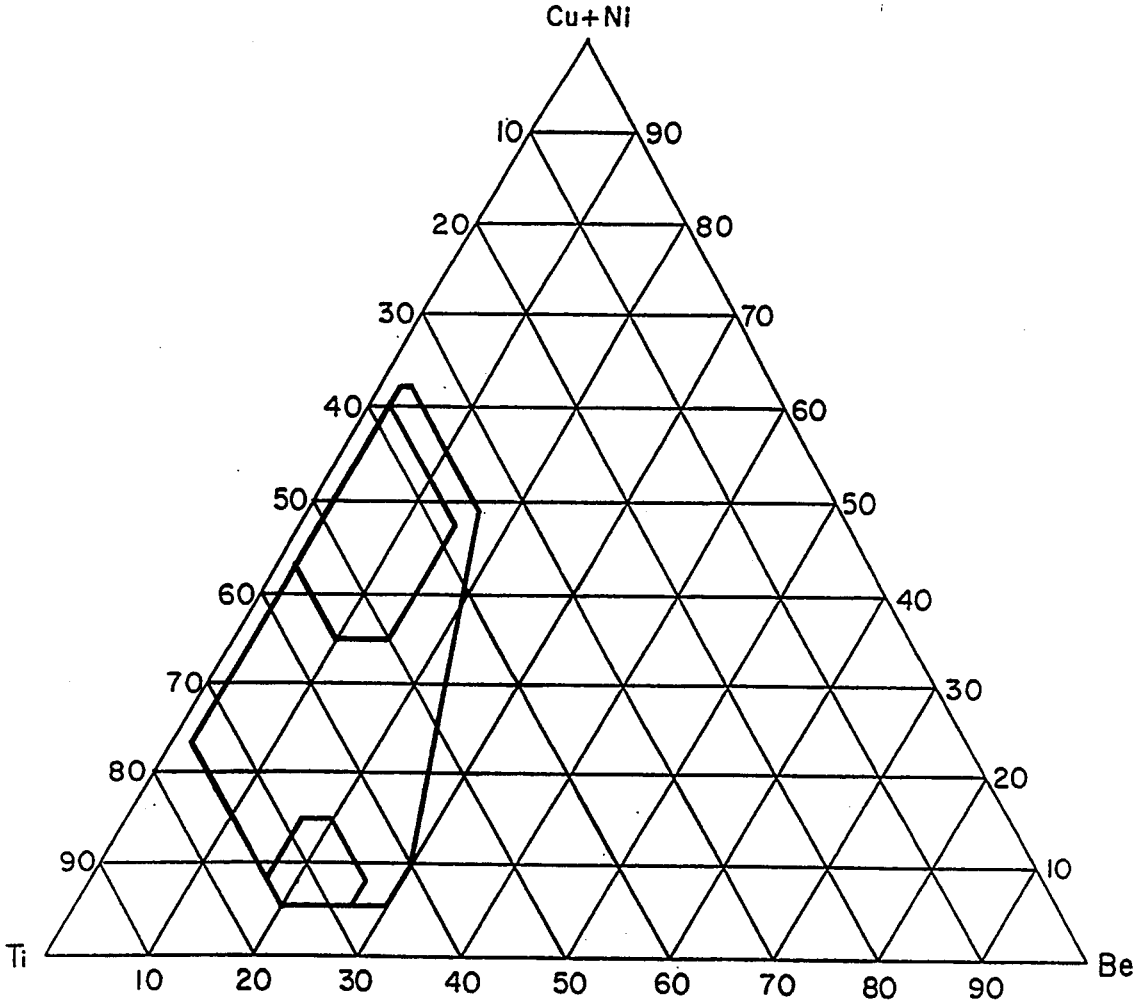
FIG. 4 is a quasi-ternary composition diagram indicating the glass forming region for a preferred group of glass forming alloys comprising titanium, copper, nickel and beryllium.
Figure 5:
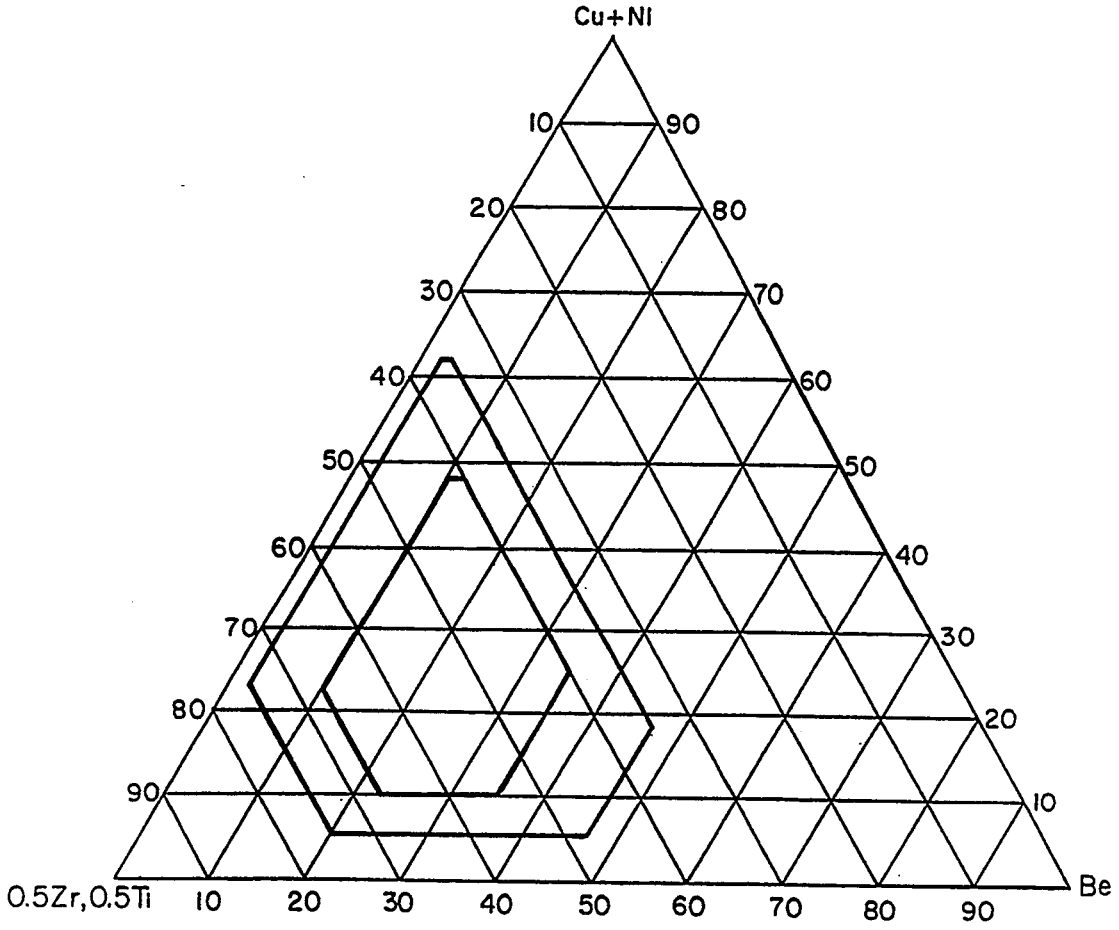
FIG. 5 is a quasi-ternary composition diagram indicating the glass forming region for a preferred group of glass forming alloys comprising titanium, zirconium, copper, nickel and beryllium.

FIGS. 4 and 5 illustrate glass forming regions for two exemplary compositions in the (Zr,Ti)(Cu,Ni)Be system. FIG. 4, for example, represents a quasi-ternary composition wherein x = 1, that is, a titanium-beryllium system where the third apex of the ternary composition diagram comprises copper and nickel. A larger area in FIG. 4 represents boundaries of a glass-forming region, as defined above numerically, for a Ti(Cu,Ni)Be system. Compositions within the larger area are glass-forming upon cooling from the melting point to a temperature below the glass transition temperature. Preferred alloys are indicated by the two smaller areas. Alloys in these ranges have particularly low critical cooling rates.

Similarly, FIG. 5 illustrates a larger hexagonal area of glass-forming compositions where x=0.5. Metallic glasses are formed upon cooling alloys within the larger hexagonal area. Glasses with low critical cooling rates are formed within the smaller hexagonal area.

In addition, the $(Zr_{1-x}Ti_x)$ moiety in such compositions may include metal selected from the group consisting of up to 25% Hf, up to 20% Nb, up to 15% Y, up to 10% Cr, up to 20% V, the percentages being of the entire alloy composition, not just the $(Zr_{1-x}Ti_x)$ moiety. In other words, such early transition metals may substitute for the zirconium and/or titanium, with that moiety remaining in the ranges described, and with the substitute material being stated as a percentage of the total alloy. Under appropriate circumstances up to 10% of metals from the group consisting of molybdenum, tantalum, tungsten, lanthanum, lanthanides, actinium and actinides may also be included. For example, tantalum, and/or uranium may be included where a dense alloy is desired.

The $(Cu_{1-y}Ni_y)$ moiety may also include additional metal selected from the group consisting of up to 25% Fe, up to 25% Co and up to 15% Mn, the percentages being of the entire alloy composition, not just the $(Cu_{1-y}Ni_y)$ moiety. Up to 10% of other Group 7 to 11 metals may also be included, but are generally too costly for commercially desirable alloys. Some of the precious metals may be included for corrosion resistance, although the corrosion resistance of metallic glasses tends to be quite good as compared with the corrosion resistance of the same alloys in crystalline form.

The Be moiety may also comprise additional metal selected from the group consisting of up to 15% Al with the Be content being at least 6%, Si up to 5% and B up to 5% of the total alloy. Preferably, the amount of beryllium in the alloy is at least 10 atomic percent.

Generally speaking, 5 to 10 percent of any transition metal is acceptable in the glass alloy. It can also be noted that the glass alloy can tolerate appreciable amounts of what could be considered incidental or contaminant materials. For example, an appreciable amount of oxygen may dissolve in the metallic glass without significantly shifting the crystallization curve. Other incidental elements, such as germanium, phosphorus, carbon, nitrogen or oxygen may be present in total amounts less than about 5 atomic percent, and preferably in total amounts less than about one atomic percent. Small amounts of alkali metals, alkaline earth metals or heavy metals may also be tolerated.

There are a variety of ways of expressing the compositions found to be good glass forming alloys. These include formulas for the compositions, with the proportions of different elements expressed in algebraic terms. The proportions are interdependent since high proportions of some elements which readily promote retention of the glassy phase can overcome other elements that tend to promote crystallization. The presence of elements in addition to the transition metals and beryllium can also have a significant influence.

For example, it is believed that oxygen in amounts that exceed the solid solubility of oxygen in the alloy may promote crystallization. This is believed to be a reason that particularly good glass-forming alloys include amounts of zirconium, titanium or hafnium (to an appreciable extent, hafnium is interchangeable with zirconium). Zirconium, titanium and hafnium have substantial solid solubility of oxygen. Commercially-available beryllium contains or reacts with appreciable amounts of oxygen. In the absence of zirconium, titanium or hafnium, the oxygen may form insoluble oxides which nucleate heterogeneous crystallization. This has been suggested by tests with certain ternary alloys which do not contain zirconium, titanium or hafnium. Splat-quenched samples which have failed to form amorphous solids have an appearance suggestive of oxide precipitates.

Some elements included in the compositions in minor proportions can influence the properties of the glass. Chromium, iron or vanadium may increase strength. The amount of chromium should, however, be limited to about 20% and preferably less than 15%, of the total content of zirconium, hafnium and titanium.

In the zirconium, hafnium, titanium alloys, it is generally preferred that the atomic fraction of titanium in the early transition metal moiety of the alloy is less than 0.7.

The early transition metals are not uniformly desirable in the composition. Particularly preferred early transition metals are zirconium and titanium. The next preference of early transition metals includes vanadium, niobium and hafnium. Yttrium and chromium, with chromium limited as indicated above, are in the next order of preference. Lanthanum, actinium, and the lanthanides and actinides may also be included in limited quantities. The least preferred of the early transition metals are molybdenum, tantalum and tungsten, although these can be desirable for certain purposes. For example, tungsten and tantalum may be desirable in relatively high density metallic glasses.

In the late transition metals, copper and nickel are particularly preferred. Iron can be particularly desirable in some compositions. The next order of preference in the late transition metals includes cobalt and manganese. Silver is preferably excluded from some compositions.

Silicon, germanium, boron and aluminum may be considered in the beryllium portion of the alloy and small amounts of any of these may be included. When aluminum is present the beryllium content should be at least 6%. Preferably, the aluminum content is less than 20% and most preferably less than 15%.

Particularly preferred compositions employ a mixture of copper and nickel in approximately equal proportions. Thus, a preferred composition has zirconium and/or titanium, beryllium and a mixture of copper and nickel, where the amount of copper, for example, is in the range of from 35% to 65% of the total amount of copper and nickel.

The following are expressions of the formulas for glass-forming compositions of differing scope and nature. Such alloys can be formed into a metallic glass having at least 50% amorphous phase by cooling the alloy from above its melting point through the glass transition temperature at a sufficient rate to prevent formation of more than 50% crystalline phase. In each of the following formulas, x and y are atomic fractions. The subscripts a, a1, b, b1, c, etc. are atomic percentages.

Exemplary glass forming alloys have the formula $$(Zr_{1-x}Ti_x)_{a1}ETM_{a2}(Cu_{1-y}Ni_y)_{b1}LTM_{b2}Be_c$$

where the early transition metal includes V, Nb, Hf, and Cr, wherein the amount of Cr is no more than 20% of a1. Preferably, the late transition metal is Fe, Co, Mn, Ru, Ag and/or Pd. The amount of the other early transition metal, ETM, is up to 40% of the amount of the $(Zr_{1-x}Ti_x)$ moiety. When x is in the range of from 0 to 0.15, (a1+a2) is in the range of from 30 to 75%, (b1+b2) is in the range of from 5 to 62%, b2 is in the range of from 0 to 25%, and c is in the range of from 6 to 47%. When x is in the range of from 0.15 to 0.4, (a1+a2) is in the range of from 30 to 75%, (b1+b2) is in the range of from 5 to 62%, b2 is in the range of from 0 to 25%, and c is in the range of from 2 to 47%.

Preferably, (a1+a2) is in the range of from 40 to 67%, (b1+b2) is in the range of from 10 to 48%, b2 is in the range of from 0 to 25%, and c is in the range of from 10 to 35%.

When x is more than 0.4, the amount of other early transition metal may range up to 40% the amount of the zirconium and titanium moiety. Then, when x is in the range of from 0.4 to 0.6, (a1+a2) is in the range of from 35 to 75%, (b1+b2) is in the range of from 5 to 62%, b2 is in the range of from 0 to 25%, and c is in the range of from 2 to 47%. When x is in the range of from 0.6 to 0.8, (a1+a2) is in the range of from 35 to 75%, (b1+b2) is in the range of from 5 to 62%, b2 is in the range of from 0 to 25%, and c is in the range of from 2 to 42%. When x is in the range of from 0.8 to 1, (a1+a2) is in the range of from 35 to 75%, (b1+b2) is in the range of from 5 to 62%, b2 is in the range of from 0 to 25%, and c is in the range of from 2 to 30%. In these alloys there is a constraint that 3c is up to (100−b1−b2) when ($b_1$+b2) is in the range of from 10 to 49%, for a value of x from 0.8 to 1.

Preferably, when x is in the range of from 0.4 to 0.6, (a1+a2) is in the range of from 40 to 67%, (b1+b2) is in the range of from 10 to 48%, b2 is in the range of from 0 to 25%, and c is in the range of from 10 to 35%. When x is in the range of from 0.6 to 0.8, (a1+a2) is in the range of from 40 to 67%, (b1+b2) is in the range of from 10 to 48%, b2 is in the range of from 0 to 25%, and c is in the range of from 10 to 30%. When x is in the range of from 0.8 to 1, either, (a1+a2) is in the range of from 38 to 55%, (b1+b2) is in the range of from 35 to 60%, b2 is in the range of from 0 to 25%, and c is in the range of from 2 to 15%; or (a1+a2) is in the range of from 65 to 75%, (b1+b2) is in the range of from 5 to 15%, b2 is in the range of from 0 to 25%, and c is in the range of from 17 to 27%.

Preferably the glass forming composition comprises a ZrTiCuNiBe alloy having the formula $$(Zr_{1-x}Ti_x)_a(Cu_{1-y}Ni_y)_bBe_c$$

where y is in the range of from 0 to 1, and x is in the range of from 0 to 0.4. When x is in the range of from 0 to 0.15, a is in the range of from 30 to 75%, b is in the range of from 5 to 62%, and c is in the range of from 6 to 47%. When x is in the range of from 0.15 to 0.4, a is in the range of from 30 to 75%, b is in the range of from 5 to 62%, and c is in the range of from 2 to 47%. Preferably, a is in the range of from 40 to 67%, b is in the range of from 10 to 35%, and c is in the range of from 10 to 35%. For example, $Zr_{34}Ti_{11}Cu_{32.5}Ni_{10}Be_{12.5}$ is a good glass forming composition. Equivalent glass forming alloys can be formulated slightly outside these ranges.

When x in the preceding formula, is in the range of from 0.4 to 0.6, a is in the range of from 35 to 75%, b is in the range of from 5 to 62%, and c is in the range of from 2 to 47%. When x is in the range of from 0.6 to 0.8, a is in the range of from 35 to 75%, b is in the range of from 5 to 62%, and c is in the range of from 2 to 42%. When x is in the range of from 0.8 to 1, a is in the range of from 35 to 75%, b is in the range of from 5 to 62%, and c is in the range of from 2 to 30% under the constraint that 3c is up to (100−b) when b is in the range of from 10 to 49%.

Preferably, when x is in the range of from 0.4 to 0.6, a is in the range of from 40 to 67%, b is in the range of from 10 to 48%, and c is in the range of from 10 to 35%. When x is in the range of from 0.6 to 0.8, a is in the range of from 40 to 67%, b is in the range of from 10 to 48%, and c is in the range of from 10 to 30%. When x is in the range of from 0.8 to 1, either a is in the range of from 38 to 55%, b is in the range of from 35 to 60%, and c is in the range of from 2 to 15%; or a is in the range of from 65 to 75%, b is in the range of from 5 to 15% and c is in the range of from 17 to 27%.

In the particularly preferred composition ranges, the $(Zr_{1-x}Ti_x)$ moiety may include up to 15% Hf, up to 15% Nb, up to 10% Y, up to 7% Cr, up to 10% V, up to 5% Mo, Ta or W, and up to 5% lanthanum, lanthanides, actinium and actinides. The $(Cu_{1-y}Ni_y)$ moiety may also include up to 15% Fe, up to 10% Co, up to 10% Mn, and up to 5% of other Group 7 to 11 metals. The Be moiety may also include up to 15% Al, up to 5% Si and up to 5% B. Preferably, incidental elements are present in a total quantity of less than 1 atomic percent.

Some of the glass forming alloys can be expressed by the formula $$((Zr,Hf,Ti)_xETM_{1-x})_a(Cu_{1-y}Ni_y)_{b1}LTM_{b2}Be_c$$

where the atomic fraction of titanium in the ((Hf, Zr, Ti) ETM) moiety is less than 0.7 and x is in the range of from 0.8 to 1; a is in the range of from 30 to 75%, (b1+b2) is in the range of from 5 to 57%, and c is in the range of from 6 to 45%. Preferably, a is in the range of from 40 to 67%, (b1+b2) is in the range of from 10 to 48%; and c is in the range of from 10 to 35%.

Alternatively, the formula can be expressed as $$((Zr,Hf,Ti)_xETM_{1-x})_aCu_{b1}Ni_{b2}LTM_{b3}Be_c$$

where x is in the range of from 0.5 to 0.8. When ETM is Y, Nd, Gd, and other rare earth elements, a is in the range of from 30 to 75%, (b1+b2+b3) is in the range of from 6 to 50%, b3 is in the range of from 0 to 25%, b1 is in the range of from 0 to 50%, and c is in the range of from 6 to 45%. When ETM is Cr, Ta, Mo and W, a is in the range of from 30 to 60%, (b1+b2+b3) is in the range of from 10 to 50%, b3 is in the range of from 0 to 25%, b1 is in the range of from 0 to x(b1+b2+b3)/2, and c is in the range of from 10 to 45%. When ETM is selected from the group consisting of V and Nb, a is in the range of from 30 to 65%, (b1+b2+b3) is in the range of from 10 to 50%, b3 is in the range of from 0 to 25%, b1 is in the range of from 0 to x(b1+b2+b3)/2, and c is in the range of from 10 to 45%.

Preferably, when ETM is Y, Nd, Gd, and other rare earth elements, a is in the range of from 40 to 67%; (b1+b2+b3) is in the range of from 10 to 38%, b3 is in the range of from 0 to 25%, b1 is in the range of from 0 to 38%, and c is in the range of from 10 to 35%. When ETM is Cr, Ta, Mo and W, a is in the range of from 35 to 50%, (b1+b2+b3) is in the range of from 15 to 35%, b3 is in the range of from 0 to 25%, b1 is in the range of from 0 to x(b1+b2+b3)/2, and c is in the range of from 15 to 35%. When ETM is V and Nb, a is in the range of from 35 to 55%, (b1+b2+b3) is in the range of from 15a to 35%, b3 is in the range of from 0 to 25%, b1 is in the range of from 0 to x(b1+b2+b3)/2, and c is in the range of from 15 to 35%.

FIGS. 4 and 5 illustrate somewhat smaller hexagonal areas representing preferred glass-forming compositions, as defined numerically herein for compositions where x=1 and x=0.5, respectively. These boundaries are the smaller size hexagonal areas in the quasi-ternary composition diagrams. It will be noted in FIG. 4 that there were two relatively smaller hexagonal areas of preferred glass-forming alloys. Very low critical cooling rates are found in both of these preferred composition ranges.

An exemplary very good glass forming composition has the approximate formula $(Zr_{0.75}Ti_{0.25})_{55}(Cu_{0.36}Ni_{0.64})_{22.5}Be_{22.5}$. A sample of this material was cooled in a 15 mm diameter fused quartz tube which was plunged into water and the resultant ingot was completely amorphous. The cooling rate from the melting temperature through the glass transition temperature is estimated at about two to three degrees per second.

With the variety of material combinations encompassed by the ranges described, there may be unusual mixtures of metals that do not form at least 50% glassy phase at cooling rates less than about $10^6$ K/s. Suitable combinations may be readily identified by the simple expedient of melting the alloy composition, splat quenching and verifying the amorphous nature of the sample. Preferred compositions are readily identified with lower critical cooling rates.

The amorphous nature of the metallic glasses can be verified by a number of well known methods. X-ray diffraction patterns of completely amorphous samples show broad diffuse scattering maxima. When crystallized material is present together with the glass phase, one observes relatively sharper Bragg diffraction peaks of the crystalline material. The relative intensities contained under the sharp Bragg peaks can be compared with the intensity under the diffuse maxima to estimate the fraction of amorphous phase present.

The fraction of amorphous phase present can also be estimated by differential thermal analysis. One compares the enthalpy released upon heating the sample to induce crystallization of the amorphous phase to the enthalpy released when a completely glassy sample crystallizes. The ratio of these heats gives the molar fraction of glassy material in the original sample. Transmission electron microscopy analysis can also be used to determine the fraction of glassy material. In electron microscopy, glassy material shows little contrast and can be identified by its relative featureless image. Crystalline material shows much greater contrast and can easily be distinguished. Transmission electron diffraction can then be used to confirm the phase identification. The volume fraction of amorphous material in a sample can be estimated by analysis of the transmission electron microscopy images.

Metallic glasses of the alloys of the present invention generally exhibit considerable bend ductility. Splatted foils exhibit 90° to 180° bend ductility. In the preferred composition ranges, fully amorphous 1 mm thick strips exhibit bend ductility and can also be rolled to about one-third of the original thickness without any macroscopic cracking. Such rolled samples can still be bent 90°.

Amorphous alloys as provided in practice of this invention have high hardness. High Vicker's hardness numbers indicate high strength. Since many of the preferred alloys have relatively low densities, ranging from about 5 to 7 g/cc, the alloys have a high strength-to-weight ratio. If desired, however, heavy metals such as tungsten, tantalum and uranium may be included in the compositions where high density is desirable. For example, a high density metallic glass may be formed of an alloy having the general composition (TaWHf)NiBe.

Appreciable amounts of vanadium and chromium are desirable in the preferred alloys since these demonstrate higher strengths than alloys without vanadium or chromium.

EXAMPLES

The following is a table of alloys which can be cast in a strip at least one millimeter thick with more than 50% by volume amorphous phase. Properties of many of the alloys are also tabulated, including the glass transition temperature $T_g$ in degrees Centigrade. The column headed $T_x$ is the temperature at which crystallization occurs upon heating the amorphous alloy above the glass transition temperature. The measurement technique is differential thermal analysis. A sample of the amorphous alloy is heated through and above the glass transition temperature at a rate of 20° C. per minute. The temperature recorded is the temperature at which a change in enthalpy indicates that crystallization commences. The samples were heated in inert gas atmosphere, however, the inert gas is of commercially available purity and contains some oxygen. Consequently the samples developed a somewhat oxidized surface. We have shown that a higher temperature is achieved when the sample has a clean surface so that there is homogeneous nucleation, rather than heterogeneous nucleation. Thus, the commencement of homogeneous crystallization may actually be higher than measured in these tests for samples free of surface oxide.

The column headed ΔT is the difference between the crystallization temperature and the glass transition temperature both of which were measured by differential thermal analysis. Generally speaking, a higher ΔT indicates a lower critical cooling rate for forming an amorphous alloy. It also indicates that there is a longer time available for processing the amorphous alloy above the glass transition temperature. A ΔT of more than 100° C. indicates a particularly desirable glass-forming alloy.

The final column in the table, headed $H_v$, indicates the Vicker's hardness of the amorphous composition. Generally speaking, higher hardness numbers indicate higher strengths of the metallic glass.

TABLE 1

| COMPOSITION | Tg | Tx | ΔT | Hv |
|---|---|---|---|---|
| $Zr_{70}Ni_{7.5}Be_{22.5}$ | 305 | 333 | 28 | |
| $Zr_{70}Cu_{12.5}Ni_{10}Be_{7.5}$ | 311 | 381 | 70 | |
| $Zr_{65}Cu_{17.5}Ni_{10}Be_{7.5}$ | 324 | 391 | 67 | 430 ± 20 |
| $Zr_{60}Ni_{12.5}Be_{27.5}$ | 329 | 432 | 103 | |
| $Zr_{60}Cu_{17.5}Ni_{10}Be_{12.5}$ | 338 | 418 | 80 | |
| $Zr_{60}Cu_{7.5}Ni_{10}Be_{22.5}$ | 346 | 441 | 95 | |
| $Zr_{55}Cu_{17.5}Ni_{10}Be_{17.5}$ | 349 | 430 | 81 | 510 ± 20 |
| $Zr_{55}Cu_{7.5}Ni_{10}Be_{27.5}$ | 343 | 455 | 112 | |
| $Zr_{55}Cu_{12.5}Ni_{10}Be_{22.5}$ | 347 | 433 | 86 | |
| $Zr_{50}Cu_{12.5}Ni_{10}Be_{27.5}$ | 360 | 464 | 104 | |
| $Zr_{50}Cu_{17.5}Ni_{10}Be_{22.5}$ | 361 | 453 | 92 | 540 ± 20 |
| $Zr_{50}Cu_{27.5}Ni_{15}Be_{7.5}$ | 389 | 447 | 58 | 540 ± 20 |
| $Zr_{45}Cu_{7.5}Ni_{10}Be_{37.5}$ | 373 | 451 | 78 | 610 ± 25 |
| $Zr_{45}Cu_{12.5}Ni_{10}Be_{32.5}$ | 375 | 460 | 85 | 600 ± 20 |
| $Zr_{40}Cu_{22.5}Ni_{15}Be_{22.5}$ | 399 | 438 | | |
| $Zr_{52.5}Ti_{17.5}Ni_{7.5}Be_{22.5}$ | | | | |
| $Zr_{48.8}Ti_{16.2}Cu_{17.5}Ni_{10}Be_{7.5}$ | 312 | 358 | 46 | |
| $Zr_{45}Ti_{15}Cu_{17.5}Ni_{10}Be_{12.5}$ | 318 | 364 | 46 | 555 ± 25 |
| $Zr_{41.2}Ti_{13.8}Cu_{17.5}Ni_{10}Be_{17.5}$ | 354 | 408 | 54 | 575 ± 25 |
| $Zr_{41.2}Ti_{13.8}Cu_{12.5}Ni_{10}Be_{22.5}$ | | | | 585 ± 20 |
| $Zr_{37.5}Ti_{12.5}Cu_{17.5}Ni_{10}Be_{22.5}$ | 364 | 450 | 86 | 570 ± 25 |

TABLE 1-continued

| COMPOSITION | Tg | Tx | ΔT | Hv |
|---|---|---|---|---|
| $Zr_{33.8}Ti_{11.2}Cu_{12.5}Ni_{10}Be_{32.5}$ | 376 | 441 | 65 | 640 ± 25 |
| $Zr_{33.8}Ti_{11.2}Cu_{7.5}Ni_{10}Be_{37.5}$ | 375 | 446 | 71 | 650 ± 25 |
| $Zr_{33.8}Ti_{11.2}Cu_{7.5}Ni_{5}Be_{42.5}$ | | | | |
| $Zr_{30}Ti_{10}Cu_{22.5}Ni_{15}Be_{22.5}$ | | | | |
| $Zr_{27.5}Ti_{27.5}Cu_{17.5}Ni_{10}Be_{17.5}$ | 344 | 396 | 52 | 600 ± 25 |
| $Zr_{35}Ti_{35}Ni_{7.5}Be_{22.5}$ | | | | |
| $Zr_{30}Ti_{30}Cu_{7.5}Ni_{10}Be_{22.5}$ | | | | |
| $Zr_{25}Ti_{25}Cu_{27.5}Ni_{15}Be_{7.5}$ | | | | |
| $Zr_{25}Ti_{25}Cu_{17.5}Ni_{10}Be_{22.5}$ | 358 | 420 | 62 | 620 ± 25 |
| $Zr_{22.5}Ti_{22.5}Cu_{12.5}Ni_{10}Be_{32.5}$ | 374 | 423 | 49 | |
| $Zr_{22.5}Ti_{22.5}Cu_{7.5}Ni_{10}Be_{37.5}$ | | | | |
| $Zr_{20}Ti_{20}Cu_{22.5}Ni_{15}Be_{22.5}$ | | | | |
| $Zr_{20}Ti_{20}Cu_{12.5}Ni_{10}Be_{37.5}$ | | | | |
| $Ti_{52.5}Zr_{17.5}Ni_{7.5}Be_{22.5}$ | | | | |
| $Ti_{45}Zr_{15}Cu_{17.5}Ni_{10}Be_{12.5}$ | — | 375 | | 655 ± 25 |
| $Ti_{37.5}Zr_{12.5}Cu_{17.5}Ni_{10}Be_{22.5}$ | 348 | 410 | 62 | 640 ± 25 |
| $Ti_{37.5}Zr_{12.5}Cu_{27.5}Ni_{15}Be_{7.5}$ | | | | |
| $Zr_{41.2}Ti_{13.8}Cu_{12.5}Ni_{10}Be_{12.5}Al_{10}$ | | | | |
| $Zr_{41.2}Ti_{13.8}Cu_{12.5}Ni_{10}Be_{7.5}Al_{15}$ | | | | |
| $Zr_{41.2}Ti_{13.8}Cu_{7.5}Be_{22.5}Fe_{15}$ | | | | |
| $Zr_{41.2}Ti_{13.8}Cu_{12.5}Ni_{10}Be_{20.0}Si_{2.5}$ | | | | |
| $Zr_{41.2}Ti_{13.8}Cu_{12.5}Ni_{10}Be_{20.0}B_{2.5}$ | | | | |
| $Zr_{55}Be_{37.5}Fe_{7.5}$ | | | | |
| $Zr_{33}Ti_{11}Cu_{12.5}Ni_{10}Be_{22.5}Y_{11}$ | | | | |
| $Zr_{36}Ti_{12}Cu_{12.5}Ni_{10}Be_{22.5}Cr_{7}$ | | | | |
| $Zr_{33.8}Ti_{11.2}Cu_{17.5}Ni_{10}Be_{17.5}Cr_{10}$ | | | | |
| $Zr_{34.5}Ti_{11.5}Cu_{12.5}Ni_{10}Be_{22.5}Nb_{9}$ | 377 | 432 | 55 | |
| $Zr_{33}Ti_{11}Cu_{12.5}Ni_{10}Be_{22.5}Hf_{11}$ | | | | |
| $Zr_{41.2}Ti_{13.8}Cu_{7.5}Mn_{15}Be_{22.5}$ | | | | |
| $Hf_{41.2}Ti_{13.8}Cu_{12.5}Ni_{10}Be_{22.5}$ | | | | 665 ± 25 |

The following table lists a number of compositions which have been shown to be amorphous when cast in a layer 5 mm. thick.

TABLE 2

| Composition | Tg | Tx | ΔT | Hv |
|---|---|---|---|---|
| $Zr_{41.2}Ti_{13.8}Cu_{12.5}Ni_{10}Be_{22.5}$ | | | | |
| $Hf_{41.2}Ti_{13.8}Cu_{12.5}Ni_{10}Be_{22.5}$ | | | | |
| $Zr_{36}Ti_{12}V_{7}Cu_{12.5}Ni_{10}Be_{22.5}$ | | | | |
| $Zr_{41.2}Ti_{13.8}Cu_{7.5}Co_{15}Be_{22.5}$ | | | | |
| $Zr_{34.5}Ti_{11.5}Nb_{9}Cu_{12.5}Ni_{10}Be_{22.5}$ | | | | |
| $Zr_{33}Ti_{11}Hf_{11}Cu_{12.5}Ni_{10}Be_{22.5}$ | | | | |
| $Zr_{30}Ti_{30}Cu_{7.5}Ni_{10}Be_{22.5}$ | | | | |
| $Zr_{37.5}Ti_{12.5}Cu_{17.5}Ni_{10}Be_{22.5}$ | | | | |

The following table lists a number of compositions which have been shown to be more than 50% amorphous phase, and generally 100% amorphous phase, when splat-quenched to form a ductile foil approximately 30 micrometers thick.

TABLE 3

| COMPOSITION | Tg | Tx | ΔT | Hv |
|---|---|---|---|---|
| $Zr_{75}Ni_{10}Be_{7.5}$ | | | | |
| $Zr_{75}Cu_{7.5}Ni_{10}Be_{7.5}$ | | | | |
| $Zr_{55}Ni_{27.5}Be_{17.5}$ | | | | |
| $Zr_{55}Cu_{5}Ni_{7.55}Be_{32.5}$ | 344 | 448 | 104 | |
| $Zr_{40}Cu_{37.5}Ni_{15}Be_{7.5}$ | 425 | 456 | 31 | |
| $Zr_{40}Cu_{12.5}Ni_{10}Be_{37.5}$ | 399 | 471 | 72 | |
| $Zr_{35}Cu_{22.5}Ni_{10}Be_{32.5}$ | | | | |
| $Zr_{35}Cu_{7.5}Ni_{10}Be_{47.5}$ | | | | |
| $Zr_{30}Cu_{37.5}Ni_{10}Be_{22.5}$ | 436 | 497 | 61 | |
| $Zr_{30}Cu_{47.5}Be_{22.5}$ | | | | |
| $Zr_{25}Cu_{37.5}Ni_{15}Be_{22.5}$ | | | | |
| $Zr_{32.5}Ti_{32.5}Cu_{17.5}Ni_{10}Be_{7.5}$ | | 336 | | 455 |
| $Zr_{30}Ti_{30}Cu_{17.5}Ni_{10}Be_{12.5}$ | 323 | 358 | 35 | 500 |
| $Ti_{48.8}Zr_{16.2}Cu_{17.5}Ni_{10}Be_{7.5}$ | | 346 | | 475 |
| $Ti_{41.2}Zr_{13.8}Cu_{17.5}Ni_{10}Be_{17.5}$ | 363 | 415 | 52 | 600 |
| $Ti_{70}Ni_{7.5}Be_{22.5}$ | | | | |
| $Ti_{65}Cu_{17.5}Ni_{10}Be_{7.5}$ | | 368 | | 530 |
| $Ti_{60}Cu_{17.5}Ni_{10}Be_{12.5}$ | | 382 | | 570 |
| $Ti_{60}Cu_{7.5}Ni_{10}Be_{22.5}$ | | 428 | | 595 |
| $Ti_{55}Cu_{17.5}Ni_{10}Be_{17.5}$ | | 412 | | 630 |
| $Ti_{55}Cu_{22.5}Ni_{15}Be_{7.5}$ | | | | |
| $Ti_{55}Ni_{27.5}Be_{17.5}$ | | | | |

TABLE 3-continued

| COMPOSITION | Tg | Tx | ΔT | Hv |
|---|---|---|---|---|
| $Ti_{50}Cu_{17.5}Ni_{10}Be_{22.5}$ | | | | |
| $Ti_{50}Cu_{27.5}Ni_{15}Be_{7.5}$ | 396 | 441 | 45 | 620 |
| $Ti_{45}Cu_{32.5}Ni_{15}Be_{7.5}$ | | | | |
| $Ti_{45}Cu_{27.5}Ni_{15}Be_{12.5}$ | | | | |
| $Ti_{40}Cu_{37.5}Ni_{15}Be_{7.5}$ | | | | |
| $Zr_{41.2}Ti_{13.8}Fe_{22.5}Be_{22.5}$ | | | | |
| $Zr_{30}Ti_{10}V_{15}Cu_{12.5}Ni_{10}Be_{22.5}$ | | | | |
| $Nb_{25}Zr_{22.5}Ti_{7.5}Cu_{12.5}Ni_{10}Be_{22.5}$ | | | | |
| $Ti_{50}Cu_{22.5}Ni_{15}Be_{12.5}$ | | | | |
| $Zr_{30}Cu_{17.5}Ni_{10}Be_{42.5}$ | | | | |
| $Zr_{40}Cu_{32.5}Ni_{15}Be_{12.5}$ | | | | |
| $Zr_{40}Cu_{37.5}Be_{22.5}$ | | | | |
| $Zr_{55}Cu_{7.5}Be_{37.5}$ | | | | |
| $Zr_{70}Cu_{22.5}Be_{7.5}$ | | | | |
| $Zr_{30}Ni_{47.5}Be_{22.5}$ | | | | |
| $Zr_{26.2}Ti_{8.8}Cu_{22.5}Ni_{10}Be_{32.5}$ | | | | |
| $Zr_{22.5}Ti_{7.5}Cu_{37.5}Ni_{10}Be_{22.5}$ | | | | |
| $Ti_{30}Zr_{10}Cu_{12.5}Ni_{10}Be_{37.5}$ | | | | |
| $Ti_{30}Zr_{10}Cu_{22.5}Ni_{15}Be_{22.5}$ | | | | |
| $Nb_{20}Zr_{30}Ni_{30}Be_{20}$ | | | | |

A number of categories and specific examples of glass-forming alloy compositions having low critical cooling rates are described herein. It will apparent to those skilled in the art that the boundaries of the glass-forming regions described are approximate and that compositions somewhat outside these precise boundaries may be good glass-forming materials and compositions slightly inside these boundaries may not be glass-forming materials at cooling rates less than 1000 K/s. Thus, within the scope of the following claims, this invention may be practiced with some variation from the precise compositions described.

What is claimed is:

1. A method for making a metallic glass having at least 50% amorphous phase comprising the steps of:

forming an alloy having the formula $$(Zr_{1-x}Ti_x)_{a1}ETM_{a2}(Cu_{1-y}Ni_y)_{b1}LTM_{b2}Be_c$$

where x and y are atomic fractions, and a1, a2, b1, b2, and c are atomic percentages, wherein:

ETM is at least one early transition metal selected from the group consisting of V, Nb, Hf, and Cr, wherein the atomic percentage of Cr is no more than 0.2 a1;

LTM is a late transition metal selected from the group consisting of Fe, Co, Mn, Ru, Ag and Pd;

a2 is in the range of from 0 to 0.4a1;

x is in the range of from 0 to 0.4; and y is in the range of from 0 to 1; and (A) when x is in the range of from 0 to 0.15:
(a1+a2) is in the range of from 30 to 75%,
(b1+b2) is in the range of from 5 to 62%,
b2 is in the range of from 0 to 25%, and
c is in the range of from 6 to 47%;

(B) when x is in the range of from 0.15 to 0.4:
(a1+a2) is in the range of from 30 to 75%,
(b1+b2) is in the range of from 5 to 62%,
b2 is in the range of from 0 to 25%, and
c is in the range of from 2 to 47%; and cooling the entire alloy from above its melting point to a temperature below its glass transition temperature at a sufficient rate to prevent formation of more than 50% crystalline phase.

2. A method as recited in claim 1 wherein ETM is only Cr and a2 is in the range of from 0 to 0.2 a1.

3. A method as recited in claim 1 wherein ETM is selected from the group consisting of V, Nb and Hf.

4. A method as recited in claim 1 wherein b2 is 0 and y is in the range of from 0.35 to 0.65.

5. A method as recited in claim 1 wherein LTM is only Fe.

6. A method as recited in claim 1 wherein
(a1+a2) is in the range of from 40 to 67%,
(b1+b2) is in the range of from 10 to 48%,
b2 is in the range of from 0 to 25%, and
c is in the range of from 10 to 35%.

7. A method as recited in claim 6 wherein b2 is 0 and y is in the range of from 0.35 to 0.65.

8. A method as recited in claim 7 wherein the alloy further comprises up to 15% Al and c is not less than 6.

9. A method as recited in claim 7 wherein the alloy further comprises additional elements selected from the group consisting of Si, Ge, and B, up to a maximum of 5%, and up to a total of 2% of other elements.

10. A method for making a metallic glass having at least 50% amorphous phase comprising the steps of:

forming an alloy having the formula $$(Zr_{1-x}Ti_x)_{a1}ETM_{a2}(Cu_{1-y}Ni_y)_{b1}LTM_{b2}Be_c$$

where x and y are atomic fractions, and a1, a2, b1, b2, b3 and c are atomic percentages, wherein:

ETM is an early transition metal selected from the group consisting of V, Nb, Hf, and Cr wherein the atomic percentage of Cr is no more than 0.2a1;

LTM is a late transition metal selected from the group consisting of Fe, Co, Mn, Ru, Ag and Pd;

a2 is in the range of from 0 to 0.4 a1;

x is in the range of from 0.4 to 1; and y is in the range of from 0 to 1; and (A) when x is in the range of from 0.4 to 0.6:
(a1+a2) is in the range of from 35 to 75%,
(b1+b2) is in the range of from 5 to 62%,
b2 is in the range of from 0 to 25%, and
c is in the range of from 2 to 47%;

(B) when x is in the range of from 0.6 to 0.8:
(a1+a2) is in the range of from 35 to 75%,
(b1+b2) is in the range of from 5 to 62%,
b2 is in the range of from 0 to 25%, and
c is in the range of from 2 to 42%; and (C) when x is in the range of from 0.8 to 1:
(a1+a2) is in the range of from 35 to 75%,
(b1+b2) is in the range of from 5 to 62%,
b2is in the range of from 0 to 25%, and
c is in the range of from 2 to 30%, under the constraint that 3c is up to (100−b1−b2) when (b1+b2) is in the range of from 10 to 49%; and cooling the entire alloy from above its melting point to a temperature below its glass transition temperature at a sufficient rate to prevent formation of more than 50% crystalline phase.

11. A method as recited in claim 10 wherein ETM is only Cr and a2 is in the range of from 0 to 0.2 a1.

12. A method as recited in claim 10 wherein ETM is selected from the group consisting of V, Nb and Hf, and a2 is in the range of from 0 to 0.4a1.

13. A method as recited in claim 10 wherein b2 is 0 and y is in the range of from 0.35 to 0.65.

14. A method as recited in claim 10 wherein LTM is only Fe.

15. A method as recited in claim 10 wherein the alloy further comprises additional elements selected from the group consisting of Si, Ge, and B, up to a maximum of 5%, and up to a total of 2% of other elements.

16. A method as recited in claim 10 wherein (A) when x is in the range of from 0.4 to 0.6:
(a1+a2) is in the range of from 40 to 67%,
(b1+b2) is in the range of from 10 to 48%,
b2 is in the range of from 0 to 25%, and
c is in the range of from 10 to 35%;

(B) when x is in the range of from 0.6 to 0.8:
(a1+a2) is in the range of from 40 to 67%,
(b1+b2) is in the range of from 10 to 48%,
b2 is in the range of from 0 to 25%, and
c is in the range of from 10 to 30%; and (C) when x is in the range of from 0.8 to 1, either:
(1) (a1+a2) is in the range of from 38 to 55%,
(b1+b2) is in the range of from 35 to 60%,
b2 is in the range of from 0 to 25%, and
c is in the range of from 2 to 15%, or
(2) (a1+a2) is in the range of from 65 to 75%,
(b1+b2) is in the range of from 5 to 15%,
b2 is in the range of from 0 to 25%, and
c is in the range of from 17 to 27%.

17. A method as recited in claim 16 wherein ETM is selected from the group consisting of V, Nb and Hf, and a2 is in the range of from 0 to 0.4a1.

18. A method as recited in claim 16 wherein b2 is 0 and y is in the range of from 0.35 to 0.65.

19. A method as recited in claim 18 wherein the alloy further comprises additional elements selected from the group consisting of Ge, Si and B up to a maximum of 5%, and up to 2% of other elements.

20. A method as recited in claim 18 wherein the alloy further comprises up to 15% aluminum and c is not less than 6.

21. A method for making a metallic glass having at least 50% amorphous phase comprising the steps of:

forming an alloy having the formula $$(Zr_{1-x}Ti_x)_a(Cu_{1-y}Ni_y)_bBe_c$$

where x and y are atomic fractions, a, b and c are atomic percentages, wherein y is in the range of from 0 to 1, x is in the range of from 0 to 0.4, and wherein:

when x is in the range of from 0 to 0.15, a is in the range of from 30 to 75%, b is in the range of from 5 to 62%, and c is in the range of from 6 to 47%; and when x is in the range of from 0.15 to 0.4, a is in the range of from 30 to 75%, b is in the range of from 5 to 62%, and c is in the range of from 2 to 47%; and cooling the entire alloy from above its melting point to a temperature below its glass transition temperature at a sufficient rate to prevent formation of more than 50% crystalline phase.

22. A method as recited in claim 21 wherein the $(Zr_{1-x}Ti_x)$ moiety also comprises additional metal selected from the group consisting of from 0 to 25% Hf, from 0 to 20% Nb, from 0 to 15% Y, from 0 to 10% Cr, from 0 to 20% V; and the $(Cu_{1-y}Ni_y)$ moiety also comprises additional metal selected from the group consisting of from 0 to 25% Fe, from 0 to 25% Co and from 0 to 15% Mn.

23. A method as recited in claim 21 wherein the alloy further comprises up to 20% aluminum and c is not less than 6.

24. A method as recited in claim 21 wherein b.y is in the range of from 5 to 15.

25. A method as recited in claim 21 wherein the alloy further comprises up to 5% of other transition metals and a total of no more than 2% of other elements.

26. A method as recited in claim 21 wherein the alloy further comprises additional elements selected from the group consisting of Si, Ge and B up to a maximum of 5%.

27. A method alloy as recited in claim 21 wherein the $(Zr_{1-x}Ti_x)$ moiety further comprises additional metal selected from the group consisting of from 0 to 25% Hf, from 0 to 20% Nb, from 0 to 15% Y, from 0 to 10% Cr, from 0 to 20% V, from 0 to 5% Mo, from 0 to 5% Ta, from 0 to 5% W, and from 0 to 5% lanthanum, lanthanides, actinium and actinides;

the $(Cu_{1-y}Ni_y)$ moiety further comprises additional metal selected from the group consisting of from 0 to 25% Fe, from 0 to 25% Co, from 0 to 15% Mn and from 0 to 5% of other Group 7 to 11 metals;

the Be moiety further comprises additional metal selected from the group consisting of from 0 to 15% Al with c not less than 6, from 0 to 5% Si and from 0 to 5% B; and the alloy comprises no more than 2% of other elements.

28. A method as recited in claim 21 wherein a is in the range of from 40 to 67%, b is in the range of from 10 to 48%, and c is in the range of from 10 to 35%.

29. A method as recited in claim 28 wherein the alloy also comprises up to 15% aluminum and c is not less than 6.

30. A method as recited in claim 28 wherein b.y is in the range of from 5 to 15.

31. A method alloy as recited in claim 28 wherein the $(Zr_{1-x}Ti_x)$ moiety further comprises additional metal selected from the group consisting of from 0 to 25% Hf, from 0 to 20% Nb, from 0 to 15% Y, from 0 to 10% Cr, from 0 to 20% V, from 0 to 5% Mo, from 0 to 5% Ta, from 0 to 5% W, and from 0 to 5% lanthanum, lanthanides, actinium and actinides;

the $(Cu_{1-y}Ni_y)$ moiety further comprises additional metal selected from the group consisting of from 0 to 25% Fe, from 0 to 25% Co, from 0 to 15% Mn and from 0 to 5% of other Group 7 to 11 metals;

the Be moiety further comprises additional metal selected from the group consisting of from 0 to 15% Al with c not less than 6, from 0 to 5% Si and from 0 to 5% B; and the alloy comprises no more than 2% of other elements.

32. A method for making a metallic glass having at least 50% amorphous phase comprising the steps of:

forming an alloy having the formula $$(Zr_{1-x}Ti_x)_a(Cu_{1-y}Ni_y)_bBe_c$$

where x and y are atomic fractions, a, b and c are atomic percentages, wherein y is in the range of from 0 to 1, x is in the range of from 0.4 to 1, and wherein:

(A) when x is in the range of from 0.4 to 0.6:
a is in the range of from 35 to 75%,
b is in the range of from 5 to 62%, and
c is in the range of from 2 to 47%;

(B) when x is in the range of from 0.6 to 0.8:
a is in the range of from 35 to 75%,
b is in the range of from 5 to 62%, and
c is in the range of from 2 to 42%; and (C) when x is in the range of from 0.8 to 1:
a is in the range of from 35 to 75%,
b is in the range of from 5 to 62%, and
c is in the range of from 2 to 30%, under the constraint that 3c is up to (100−b) when b is in the range of from 10 to 49%; and cooling the entire alloy from above its melting point to a temperature below its glass transition temperature at a sufficient rate to prevent formation of more than 50% crystalline phase.

33. A method as recited in claim 32 wherein the $(Zr_{1-x}Ti_x)$ moiety further comprises additional metal selected from the group consisting of from 0 to 25% Hf, from 0 to 20% Nb, from 0 to 15% Y, from 0 to 10% Cr, from 0 to 20% V; and the $(Cu_{1-y}Ni_y)$ moiety further comprises additional metal selected from the group consisting of from 0 to 25% Fe, from 0 to 25% Co and from 0 to 15% Mn.

34. A method alloy as recited in claim 32 wherein $(Zr_{1-x}Ti_x)$ moiety further comprises additional metal selected from the group consisting of from 0 to 25% Hf, from 0 to 20% Nb, from 0 to 15% Y, from 0 to 10% Cr, from 0 to 20% V, from 0 to 5% Mo, from 0 to 5% Ta, from 0 to 5% W, and from 0 to 5% lanthanum, lanthanides, actinium and actinides;

the $(Cu_{1-y}Ni_y)$ moiety further comprises additional metal selected from the group consisting of from 0 to 25% Fe, from 0 to 25% Co, from 0 to 15% Mn and from 0 to 5% of other Group 7 to 11 metals;

the Be moiety further comprises additional metal selected from the group consisting of from 0 to 15% Al with c not less than 6, from 0 to 5% Si and from 0 to 5% B; and the alloy comprises no more than 2% of other elements.

35. A method as recited in claim 32 wherein the alloy further comprises up to 20% Al and c is not less than 6.

36. A method as recited in claim 32 wherein b.y is in the range of from 5 to 15.

37. A method as recited in claim 32 wherein the alloy further comprises up to 5% other transition metals and a total amount of no more than 2% of other elements.

38. A method as recited in claim 32 wherein the alloy further comprises additional elements selected from the group consisting of Si, Ge, and B, up to a maximum of 5%.

39. A method as recited in claim 32 wherein (A) when x is in the range of from 0.4 to 0.6:
a is in the range of from 40 to 67%,
b is in the range of from 10 to 48%, and
c is in the range of from 10 to 35%;

(B) when x is in the range of from 0.6 to 0.8:
a is in the range of from 40 to 67%,
b is in the range of from 10 to 48%, and
c is in the range of from 10 to 30%; and (C) when x is in the range of from 0.8 to 1, either:
(1) a is in the range of from 38 to 55%,
b is in the range of from 35 to 60%, and
c is in the range of from 2 to 15%, or
(2) a is in the range of from 65 to 75%,
b is in the range of from 5 to 15%, and
c is in the range of from 17 to 27%.

40. A method as recited in claim 39 wherein b.y is in the range of from 5 to 15.

41. A method as recited in claim 39 wherein the alloy further comprises up to 15% Al and c is not less than 6.

42. A method as recited in claim 39 wherein the alloy further comprises up to 5% other transition metals and a total amount of no more than 2% of other elements.

43. A method for making a metallic glass having at least 50% amorphous phase comprising the steps of:

forming an alloy having the formula $$((Zr,Hf,Ti)_xETM_{1-x})_a(Cu_{1-y}Ni_y)_{b1}LTM_{b2}Be_c$$

where x and y are atomic fractions, and a, b1, b2, and c are atomic percentages;

the atomic fraction of Ti in the ((Hf,Zr,Ti) ETM) moiety is less than 0.7;

x is in the range of from 0.8 to 1;

LTM is a late transition metal selected from the group consisting of Ni, Cu, Fe, Co, Mn, Ru, Ag and Pd;

ETM is an early transition metal selected from the group consisting of V, Nb, Y, Nd, Gd and other rare earth elements, Cr, Mo, Ta, and W;

a is in the range of from 30 to 75%;

(b1+b2) is in the range of from 5 to 57%; and c is in the range of from 6 to 45%; and cooling the entire alloy from above its melting point to a temperature below its glass transition temperature at a sufficient rate to prevent formation of more than 50% crystalline phase.

44. A method as recited in claim 43 wherein ETM is an early transition metal selected from the group consisting of Y, Nd, Gd and other rare earth elements.

45. A method as recited in claim 43 wherein ETM is an early transition metal selected from the group consisting of V and Nb.

46. A method as recited in claim 43 wherein ETM is an early transition metal selected from the group consisting of V, Nb, Cr, Ta, Mo, and W.

47. A method as recited in claim 43 wherein LTM is only Fe.

48. A method as recited in claim 43 wherein x is 1 and b2 is 0.

49. A method as recited in claim 43 wherein a is in the range of from 40 to 67%;

(b1+b2) is in the range of from 10 to 48%; and c is in the range of from 10 to 35%.

50. A method as recited in claim 43 wherein the alloy further comprises additional elements selected from the group consisting of Si, Ge and B up to a maximum of 5%.

51. A method as recited in claim 48 wherein the alloy further comprises up to 15% Al and c is not less than 6.

52. A method as recited in claim 49 wherein x is 1, b2 is 0 and y is in the range of from 0.35 to 0.65.

53. A method as recited in claim 49 wherein the alloy further comprises up to 15% Al and the atomic percentage of Be is not less than 6.

* * * * *

UNITED STATES PATENT AND TRADEMARK OFFICE

CERTIFICATE OF CORRECTION

PATENT NO. : 5,368,659

DATED : November 29, 1994

INVENTOR(S) : Atakan Peker; William L. Johnson

It is certified that error appears in the above-indentified patent and that said Letters Patent is hereby corrected as shown below:

On the Title Page:

IUM" to

Item [56], References Cited, U.S. PATENT DOCUMENTS change "5,043,023 8/1991 Gerling et al..."
to -- 5,043,027 8/1991 Gerling et al... --.

Column 6, line 53, change "by" to -- b·y --.

Signed and Sealed this

Eighth Day of August, 1995

*Attest:*

*Attesting Officer*

BRUCE LEHMAN

*Commissioner of Patents and Trademarks*